US010625407B2

(12) United States Patent
Sato et al.

(10) Patent No.: US 10,625,407 B2
(45) Date of Patent: Apr. 21, 2020

(54) DRIVING MACHINE

(71) Applicant: Hitachi Koki Co., Ltd., Tokyo (JP)

(72) Inventors: Shinichirou Sato, Ibaraki (JP); Yasuki Ohmori, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 423 days.

(21) Appl. No.: 15/314,505

(22) PCT Filed: May 22, 2015

(86) PCT No.: PCT/JP2015/064753
§ 371 (c)(1),
(2) Date: Nov. 28, 2016

(87) PCT Pub. No.: WO2015/182508
PCT Pub. Date: Dec. 3, 2015

(65) Prior Publication Data

US 2017/0190037 A1 Jul. 6, 2017

(30) Foreign Application Priority Data

May 30, 2014 (JP) ..... 2014-112176
Sep. 30, 2014 (JP) ..... 2014-201453

(51) Int. Cl.
*B25C 1/06* (2006.01)

(52) U.S. Cl.
CPC ..... *B25C 1/06* (2013.01)

(58) Field of Classification Search
CPC ..... B25C 1/06; B25C 1/18; B25C 5/10
(Continued)

(56) References Cited

U.S. PATENT DOCUMENTS 2,720,119 A * 10/1955 Sherman ..... F16H 55/16 74/460
4,161,272 A 7/1979 Brockl
(Continued)

FOREIGN PATENT DOCUMENTS

CN 101486180 7/2009
GB 1576899 A * 10/1980 ..... B25C 1/06
(Continued)

OTHER PUBLICATIONS

"International Search Report (Form PCT/ISA/210)", dated Jun. 30, 2015, with English translation thereof, pp. 1-4.
(Continued)

*Primary Examiner* — Alex M Valvis
*Assistant Examiner* — David G Shutty
(74) *Attorney, Agent, or Firm* — JCIPRNET

(57) ABSTRACT

In order to provide a driving machine which achieves reciprocating movements of a rack using a simple mechanism and is able to smoothly engage and disengage the rack by reducing the friction during engagement and disengagement of the rack, the driving machine is equipped with: a nose that extends in a prescribed direction; a housing that has the nose; a blade that has an engaging section, is movably guided in the housing in the prescribed direction, and is capable of driving a fastener via the nose; and a transmission mechanism that has an engaged section for engaging with the engaging section in order to transmit a driving force, wherein the transmission mechanism has a roller mechanism for guiding the engaging section and engaged section to disengage from each other.

6 Claims, 10 Drawing Sheets

(58) Field of Classification Search
USPC ..... 227/130, 131, 132, 140, 146; 74/29, 30, 74/32, 33
See application file for complete search history.

(56) References Cited

U.S. PATENT DOCUMENTS 4,215,808 A * 8/1980 Sollberger ..... B25C 1/041 173/204
4,807,793 A * 2/1989 Ghibely ..... B25C 5/15 227/131
5,388,749 A * 2/1995 Davignon ..... B65C 7/006 227/67
7,334,715 B2 * 2/2008 Oda ..... B25C 1/06 173/178
2005/0082334 A1 * 4/2005 Hu ..... B25C 1/06 227/131
2006/0027622 A1 * 2/2006 Sun ..... B25C 1/06 227/131
2007/0210134 A1 * 9/2007 Oda ..... B25C 1/06 227/131
2007/0284406 A1 * 12/2007 Okouchi ..... B25C 1/06 227/132
2009/0090759 A1 * 4/2009 Leimbach ..... B25C 1/047 227/10
2009/0188766 A1 * 7/2009 Shima ..... B25C 1/06 192/48.92

FOREIGN PATENT DOCUMENTS

| | | |
|---|---|---|
| JP | S63-174882 | 7/1988 |
| JP | 2005-529763 | 10/2005 |
| JP | 2007-237345 | 9/2007 |
| JP | 2008-12615 | 1/2008 |
| JP | 2008-168426 | 7/2008 |
| JP | 2009-166155 | 7/2009 |
| JP | 2009166155 | 7/2009 |
| WO | 2007058150 | 5/2007 |

OTHER PUBLICATIONS

"Office Action of China Counterpart Application," with machine English translation thereof, dated Jul. 12, 2018, p. 1-p. 10.

* cited by examiner

DRIVING MACHINE

CROSS-REFERENCE TO RELATED APPLICATIONS

This application is a 371 application of an International PCT application Ser. No. PCT/JP2015/064753, filed on May 22, 2015, which claims the priority benefits of Japan Application No. 2014-112176, filed on May 30, 2014, and Japan Application No. 2014-201453, filed on Sep. 30, 2014. The entirety of each of the above-mentioned patent applications is hereby incorporated by reference herein and made a part of this specification.

BACKGROUND OF THE INVENTION

1. Field of the Invention

The invention relates to a driving machine, more particularly, to a driving machine including a rack and pinion mechanism.

2. Description of Related Art

In the conventional art, the following driving machine has been proposed. Said driving machine includes: a nose; a housing, having the nose; a plunger, disposed in the housing; a blade, connected to the plunger and capable of firing a fastener via the nose; a rack, disposed on the plunger; and an engaging section, for engaging with a rack to transmit a driving force (Patent Document 1).

PRIOR ART DOCUMENT

Patent Document

Patent Document 1: Japanese Patent Publication No. 2007-237345

SUMMARY OF THE INVENTION

Problems to be Solved by the Invention

The conventional driving machine is well-known for the mechanism used in driving nail by transmitting a driving kinetic energy stored in a fly wheel to the rack via the engaging section (a pinion section). Because the driving kinetic energy stored in the fly wheel is used, when aforesaid structure is used in the driving machine capable of driving long nails, improvements are still to be made on a time lag until the sufficient driving kinetic energy is generated and supplied for driving nail.

For solving this practical issue, the invention aims to provide a driving machine as follows. The driving machine can achieve reciprocating movements of a rack using a simple mechanism for a smooth nailing and can smoothly engage and disengage the rack by reducing the friction.

Technical Means for Solving the Problem

The invention provides a driving machine, which includes: a nose, extending in a prescribed direction; a housing, having the nose; a blade, having an engaging section, movably guided in the housing in the prescribed direction, and capable of driving a fastener via the nose; and a transmission mechanism, having an engaged section for engaging with the engaging section in order to transmit a driving force. The transmission mechanism has a roller mechanism for guiding the engaging section and engaged section to disengage from each other.

In the driving machine according to aforesaid structure, the friction generated during engagement and disengagement may be reduced so the driving force may be smoothly transmitted because the roller mechanism is used to engage the engaging section with the engaged section. In this way, wearing or damage on the engaged section and the engaging section may be prevented as a result. Further, light weight, miniaturization, or reduction in manufacturing costs may be achieved for the driving machine because the blade may be moved without using the fly wheel.

Preferably, the engaged section includes a pinion and the roller mechanism, and includes one end portion for starting an engagement with the engaging section and another end portion for disengaging the engagement via the roller mechanism.

In the driving machine according to aforesaid structure, the driving force may be smoothly transmitted because the engagement and the disengagement take place at the end portions.

Preferably, the roller mechanism is capable of moving relative to the pinion in a circumferential direction of the pinion.

In the driving machine according to aforesaid structure, the friction during the engagement with the engaging section may be prevented or reduced by a roller shifting of the roller mechanism so the engaged section and the engaging section can smoothly engage. The so-called "smoothly engage" refers to allowing a part of the engaging section to be processed into different members including certain manufacturing deviation, or allowing a pitch of the engaging section to include certain manufacturing deviation. Besides, light weight, miniaturization, or reduction in manufacturing costs may be achieved for the driving machine because aforesaid effect may be achieved using the rack and pinion mechanism which belongs to a relatively simple mechanism.

Preferably, the transmission mechanism further includes a driving shaft for transmitting the driving force to the engaged section, where the driving shaft is connected to the pinion.

In the driving machine according to aforesaid structure, by connecting the driving shaft to the pinion, the driving force may be transmitted to the engaged section via the pinion using a simple structure.

Preferably, the transmission mechanism further includes a restriction section. The pinion is in contact with the roller mechanism at the restriction section so a relative shifting of the roller mechanism relative to the pinion is restricted.

In the driving machine according to aforesaid structure, excessive deformation or shifting of the transmission mechanism may be prevented and excessive deformation or damage on an elastomer may also be prevented.

Preferably, the engaging section includes a rack and a guided section guided by the roller mechanism, and the engaging section and the guided section are formed in different pitches.

In the driving machine according to aforesaid structure, by being formed in different pitches, the engaging section can include a large cross section to increase a tolerable loading of the engaging section. As a result, wearing or damage on the engaging section may be prevented, and a loading applied to the blade may be increased to thereby increase a nailing force. Moreover, because the engaged section includes a roller, the engaged section and engaging section can still smoothly engage even though the engaging section has a different pitch. The so-called "smoothly engage" refers to allowing a part of the engaging section to be processed into different members including certain manufacturing deviation, or allowing a pitch of the engaging section to include certain manufacturing deviation. Besides, light weight, miniaturization, or reduction in manufacturing costs may be achieved for the driving machine because aforesaid effect may be achieved using the relatively simple mechanism.

Preferably, the roller mechanism includes a roller formed by an elastomer material.

In the engaging section according to aforesaid structure, the engaging section and the engaged section can smoothly engage because the roller is the elastomer and the roller deforms during the engagement.

Preferably, the roller mechanism is connected to the pinion through an elastic member.

In the engaging section according to aforesaid structure, the pitch of the engaged section is variable because the elastic member deforms during the engagement. Therefore, the engaging section and the engaged section can still smoothly engage even though the engaging section has a different pitch.

The invention further provides a driving machine, which includes: a nose, extending in a prescribed direction; a housing, having the nose; a blade, having an engaging section, movably guided in the housing in the prescribed direction, and capable of driving a fastener via the nose; and a transmission mechanism, transmitting a driving force to the blade, The transmission mechanism includes a pinion capable of engaging with the engaging section, and a cam connected to the pinion through an elastic member and capable of engaging with the engaging section.

In the driving machine according to aforesaid structure, the cam or the pinion can shift in the circumferential direction when the engaging section engages with the cam or the pinion because the cam and the pinion are connected through the elastic member. Therefore, the engaging section and the engaged section can smoothly engage because the friction during the engagement of the engaged section and the engaging section may be prevented or reduced even though the pitch of the engaging section includes the deviation or the engaging section has a different pitch. Besides, a high tolerable loading may be provided in order to transmit a greater driving force because the engaged section includes a member larger than teeth of the pinion (i.e., the cam). As a result, wearing or damage on the engaged section may be prevented, or the loading applied to the blade may be increased to thereby increase the nailing force.

Besides, light weight, miniaturization, or reduction in manufacturing costs may be achieved for the driving machine because aforesaid effect may be achieved using the relatively simple mechanism.

Preferably, the transmission mechanism further includes a restriction section. The pinion is in contact with the cam at the restriction section so a relative shifting of the cam relative to the pinion is restricted.

According to aforesaid structure, excessive deformation of the transmission mechanism may be prevented and excessive deformation or damage on the elastomer may also be prevented.

In addition, the invention further provides a driving machine, which includes: a nose, extending in a prescribed direction; a housing, having the nose; a blade, having an engaging section, movably guided in the housing in the prescribed direction, and capable of driving a fastener via the nose; and a transmission mechanism, transmitting a driving force to the blade, The engaging section includes a rack and a guided section. The rack and the guided section are formed in different pitches. The transmission mechanism includes an engaged section for engaging with the engaging section and the guided section and formed in different pitches, and a driving shaft connected to the engaging section through an elastic member and transmitting a driving force to the engaged section.

In the driving machine according to aforesaid structure, the engaged section can shift in the circumferential direction during the engagement with the engaging section because the engaged section is connected to the driving shaft through the elastic member. Therefore, the engaging section and the engaged section can smoothly engage because the friction during the engagement of the engaged section and the engaging section may be prevented or reduced even though the pitch of the engaging section includes the deviation or the engaging section has a different pitch. Besides, the engaging section and the engaged section can include the teeth with the large cross section due to the different pitches, so as to increase the tolerable loading of the engaging section. As a result, wearing or damage on the engaged section may be prevented, or the loading applied to the blade may be increased to thereby increase the nailing force.

Besides, light weight, miniaturization, or reduction in manufacturing costs may be achieved for the driving machine because aforesaid effect may be achieved using the relatively simple mechanism.

Preferably, the transmission mechanism further includes a restriction section. The engaged section is in contact with the driving shaft at the restriction section so a relative shifting of the engaged section relative to the driving shaft is restricted.

In the driving machine according to aforesaid structure, excessive deformation of the elastomer may be prevented by restricting the shifting by the restriction section. Therefore, plastic deformation and damage on the elastomer may be prevented.

Preferably, the elastic member includes at least one of a metal spring, an elastomer or an elastic resin.

In the driving machine according to aforesaid structure, applications corresponding to the embodiments may be conducted because the elastic member can adopt use of various materials. In all of various embodiments, the engaging section and the engaged section can smoothly engage.

Further, preferably, the transmission mechanism is able to conduct a rotation and transmit the driving force to the engaging section through the rotation, and a backward rotation restriction mechanism allowing a forward rotation and restricting a backward rotation for the transmission mechanism is disposed in the housing.

According to aforesaid structure, the backward rotation of the transmission mechanism may be restricted by the backward rotation restriction mechanism. In this way, a finishing grade may be favorably maintained and a usability may be improved.

In addition, preferably, the backward rotation restriction mechanism includes a one-way clutch.

According to aforesaid structure, the structure for restricting the backward rotation of the transmission mechanism may be achieved by using the relatively simple mechanism.

Effects of the Invention

According to the invention, the following driving machine may be provided. Said driving machine can achieve the reciprocating movements of the rack by the simple mechanism and can reduce the friction so the rack can smoothly engage and disengage.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

<First Embodiment>

In the followings, one example of the driving machine (i.e., a driving machine 1 of electric type) according to the first embodiment is described with reference to FIG. 1 to FIG. 3(*a*) to FIG. 3(*c*). The driving machine 1 shown in FIG. 1 mainly includes a housing 2 as an outer shell, a nose 4 disposed on the housing 2 and a magazine 5 for supplying a nail N to the nose 4. In order to prevent the drawings from becoming unclear, the magazine 5 are illustrated by solid lines. Furthermore, in FIG. 1, the right side of the paper is defined as a rear direction of the driving machine 1; the left side of the paper is defined as a front direction of the driving machine 1; the upper side of the paper is defined as a top direction of the driving machine 1; the lower side of the paper is defined as a bottom direction of the driving machine 1; the in-depth side of the paper is defined as a left direction of the driving machine 1; and the near-face side of the paper is defined as a right direction of the driving machine 1.

Figure 1:
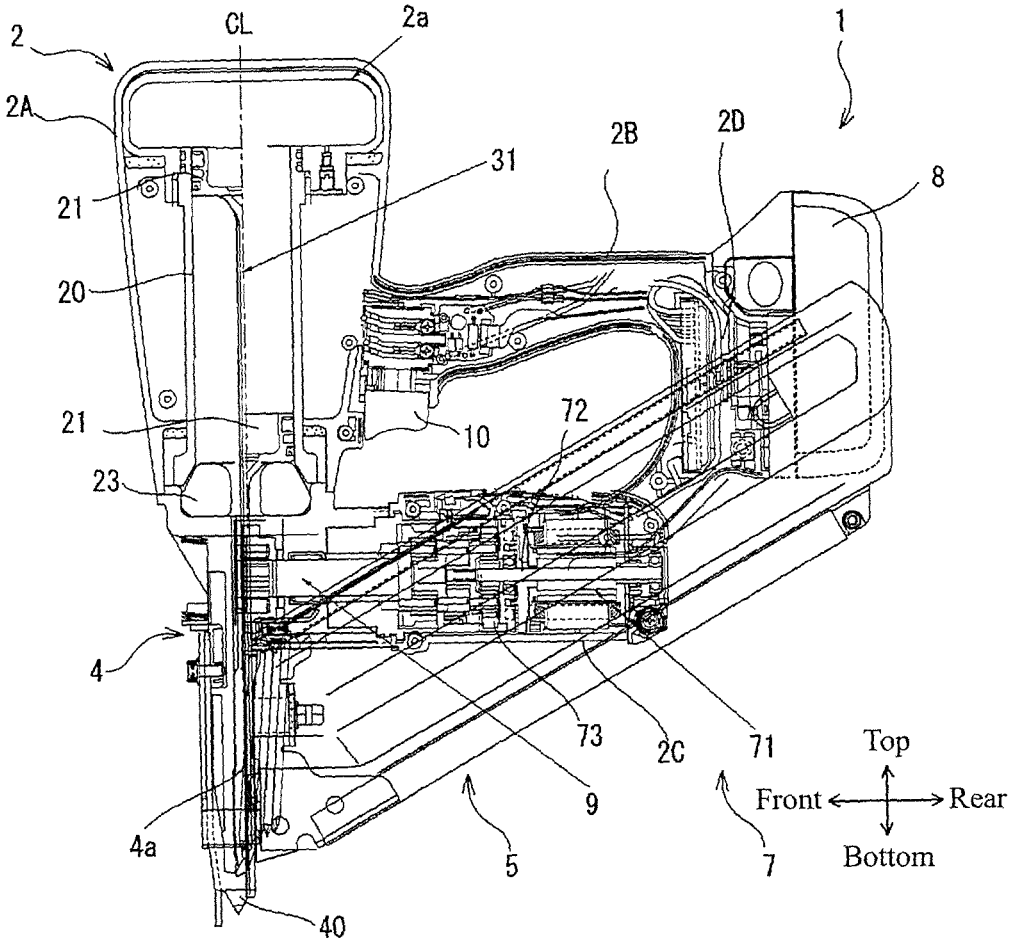
FIG. 1 is a cross sectional view of a driving machine according to the first embodiment of the invention.

As shown in FIG. 1, the housing 2 accommodates a driving section 7 and a punching mechanism 3, etc. The housing 2 includes a body section 2A, a handle 2B, a driving section accommodating section 2C and a cell connection section 2D. The cell connection section 2D constitutes the rear of the housing 2, and is able to load and unload a cell 8 which supplies power to the driving section 7. The handle 2B is formed extending from the body section 2A in the rear direction to be connected to the cell connection section 2D. A trigger 10 electrically connected to the driving section 7 is disposed on a front base end of the handle 2B. The driving section accommodating section 2C is formed extending from the bottom of the body section 2A in the rear direction to be connected to the bottom of the cell connection section 2D, and accommodates the driving section 7 and a driving shaft 9.

The body section 2A mainly accommodates the punching mechanism 3 and has the bottom connected to the nose 4. Further, the body section 2A includes a cylinder 20 extending along the top/bottom direction, a piston 21, a piston bumper 23 and a pressure chamber 2*a*.

The driving section 7 mainly includes a motor 71, an output shaft 72 of the motor and a decelerate mechanism 73, and transmits a driving force to the driving shaft 9. The decelerate mechanism 73 includes a planet gear mechanism for transmitting the driving force from the output shaft 72.

The cylinder 20 extends along the top/bottom direction, and has the bottom connected to the nose 4 and the top disposed inside the body section 2A on the top. The cylinder 20 guides a movement of the piston 21 in the top/bottom direction, and restricts movements in directions other than the up/bottom direction.

The piston 21 is disposed in the cylinder 20, and is able to move back and forth between a top stop point on the top and a bottom stop point on the bottom in the cylinder 20. Furthermore, FIG. 1 shows situations where the piston 21 reaches the top stop point and the bottom stop point, respectively (referring to the left and right sides of a center line CL of the body section 2A, respectively). The piston 21 is in contact with the piston bump 23 at the bottom stop point.

The pressure chamber 2*a* is disposed above the cylinder 20 connecting through the cylinder 20 (i.e., above the top stop point of the piston 21). That is to say, a space is integrally formed by the cylinder 20 and the pressure chamber 2*a* above the piston 21. The pressure chamber 2*a* is filled with a compressed gas such as Nitrogen or the like so the piston 21 may be forced in the bottom direction by a pressure of the compressed gas.

Figure 2:
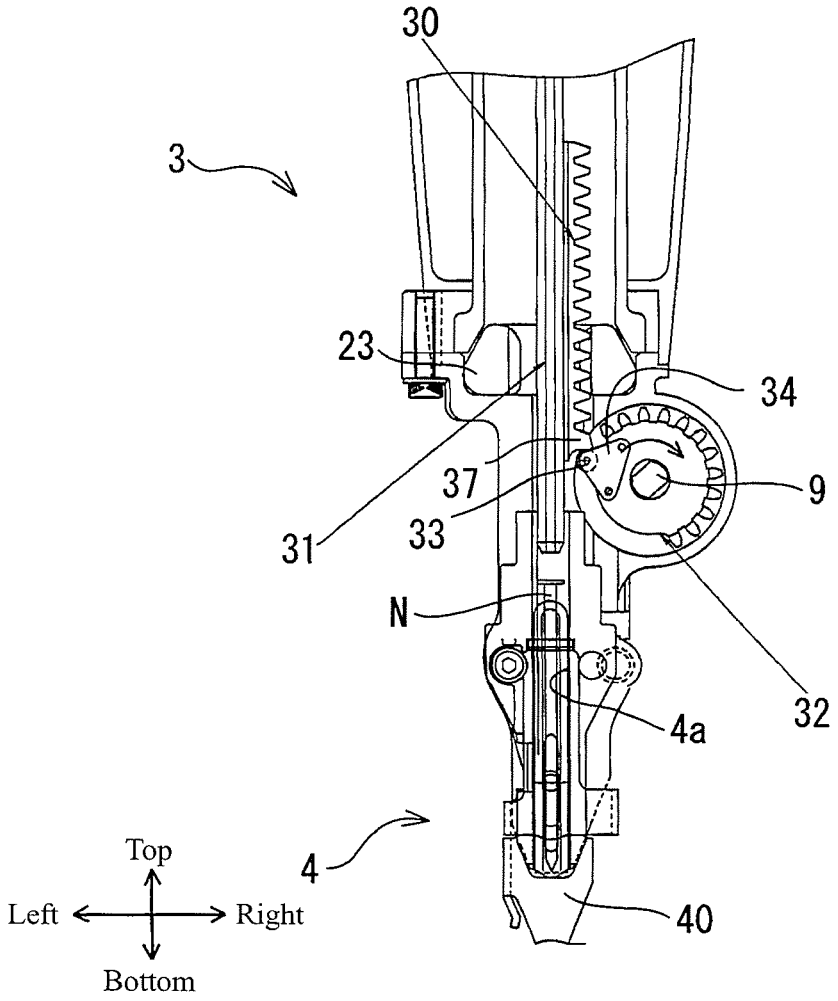
FIG. 2 is a partial cross sectional view illustrating a punching mechanism and a nose of the driving machine when inspecting from the front side according to the first embodiment of the invention.

As shown in FIG. 2, the punching mechanism 3 includes a blade 31, a rack 30, a pinion 32, a roller 33, a cam 34 and a guided section 37.

The blade 31 is a stick-like member extending along the top/bottom direction, which is connected to the bottom of the piston 21 and able to move together with the piston 21. When the blade 31 conducts reciprocating movements together with the piston 21 in the top/bottom direction, the nail N disposed on the nose 4 may be fired. The rack 31 is disposed on the bottom of the blade 31 and a lateral side of the blade 31.

The rack 30 is constituted by a plurality of teeth formed with a uniform pitch, and disposed on the bottom and the lateral side of the blade 31 along an axial direction of the blade 31. The rack 30 can engage with the pinion 32 to receive the driving force for guiding the movement of the blade 31 in the top direction. The guided section 37 is disposed below the rack 30.

The guided section 37 is disposed on the lateral side of the blade 31 and below the rack 30 to form a teeth row connected with the rack 30, and can engage with the roller 33. The guided section 37 is a section engaging with the roller 33 when the piston 21 is located at the top stop point. At this time, the pressure of the pressure chamber 2*a* is at the highest so a large loading is applied to the guided section 37. Accordingly, the guided section 37 needs to have high rigidity or strength. For that reason, the guided section 37 has a shape longer than the teeth of the rack 30 in the axial direction of the blade 31, and formed with a pitch different from that of the teeth of rack 30 (i.e., different pitches). The rack 30 and the guided section 37 may be a member integrally formed in one process or may be members respectively formed in different processes. Moreover, the rack 30 and the guided section 37 are equivalent to the engaging section in the invention.

The pinion 32 has teeth with the same pitch as the rack 30 and can engage with the rack 30. The pinion 32 has a shaft section connected to the driving shaft 9 in order to rotate together with the driving shaft 9 so the pinion 32 can receive the driving force from the driving shaft 9. The pinion 32 transmits the driving force to the rack 30 through the engagement with the rack 30. Further, the pinion 32 is connected with the cam 34.

The cam 34 shows a generally triangular shape protruding outwardly along a radial direction of the pinion 32. Specifically, the cam 34 is secured on the pinion 32 with one vertex of the generally rectangular shape formed as protrusion protruding outwardly along the radial direction of the pinion 32. Further, the roller 33 is rotatably supported by said protrusion.

The roller 33 shows a generally cylindrical shape extending along the front/rear direction. The roller 33 can rotate on the cam 34 with an axis extending along the front/rear direction as the center and can engage with the guided section 37. Specifically, the roller 33 has a tooth which has a shape different from the teeth of the pinion 32 and connected to the teeth of the pinion 32 to form a teeth row. Said teeth row is formed in a different pitch. The teeth row can engage with the rack 30 and the guided section 37 (i.e., the engaging section). The roller 33 has an elastomer containing an elastomer resin, such as rubber. The roller 33 is one example of the another end portion in the invention.

A channel 4*a* is formed in the nose 4 for the nail to pass through from the bottom of the housing 2 to a front end of the nose 4. The blade 31 may be inserted through the channel 4*a* so the blade 31 can fire the nail N disposed in the channel 4*a* when the blade 31 moves in the bottom direction. Further, a push rod 40 is disposed on the front end of the nose 4 and the driving machine 1 can drive the nail N only when the push rod 40 is pressed against a to-be-driven member. Furthermore, the nail N in the present embodiment is equivalent to the fastener in the invention.

The magazine 5 at the bottom of the housing 2 extends from the rear of the nose 4 in the rear direction to be connected with the bottom of the cell connection section 2D. The magazine 5 is disposed inside with a plurality of the nails N in bundles, and can supply the nails N into the channel 4*a* of the nose 4.

The pinion 32, the roller 33 and the cam 34 are equivalent to the engaged section in the invention. Further, the roller 33 and the cam 34 are equivalent to the roller mechanism in the invention. The roller 33, the cam 34, the driving shaft 9 and the pinion 32 are equivalent to the transmission mechanism in the invention.

Users can push the push rod 40 to a to-be-processed member and pull the trigger 10 in order to start operating the driving machine 1. After the trigger 10 is pulled, the driving section 7 starts operating so the motor 71 transmits the driving force to the driving shaft 9 via the output shaft 72 and the decelerate mechanism 73. After receiving the driving force via the driving shaft 9, the pinion 32 rotates together with the cam 34 in the clockwise direction in FIG. 3(*a*) to FIG. 3(*c*) to engage with the rack 30, and thus the piston 21 and the blade 31 located at the bottom stop point can move in the top direction withstanding the force (pressure) of the compressed gas in the pressure chamber 2*a*. When the pinion 32 rotates in the clockwise direction in FIG. 3(*a*) to FIG. 3(*c*) and starts to engage with the rack 30, the first tooth to engage with the rack 30 among the teeth of the pinion 32 (i.e., the tooth at the most downstream in the clockwise direction among the teeth of the pinion 32) is one example of the one end portion in the invention.

Figures 3A, 3B, 3C:
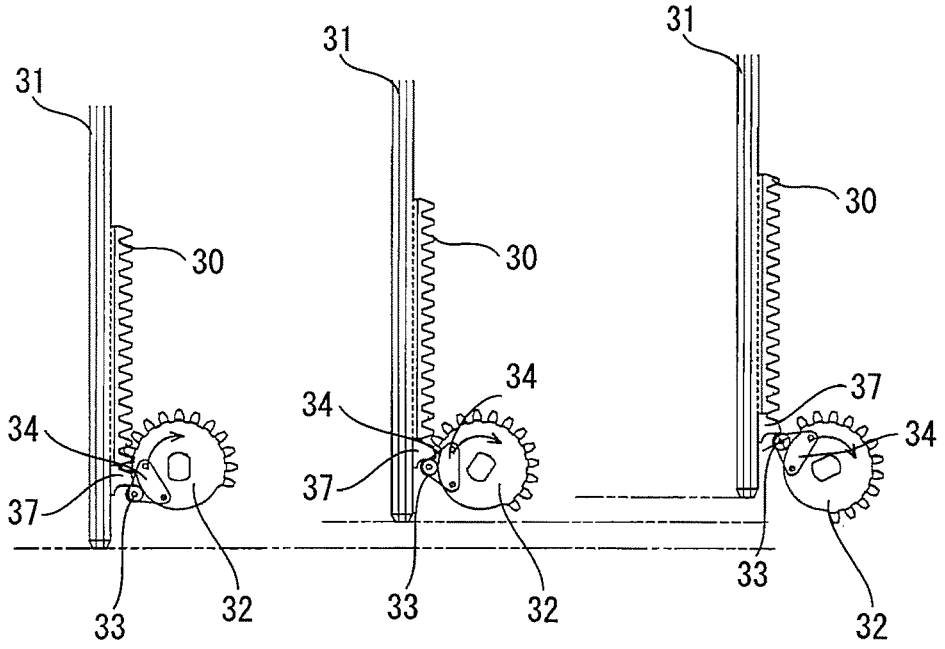
FIG. 3(*a*) to FIG. 3(*c*) are diagrams illustrating operations of the punching mechanism of the driving machine according to the first embodiment of the invention.

After further rotation of the pinion 32, as shown by FIG. 3(*a*), the roller 33 engages with the guided section 37 so the blade 31 moves further in the top direction (FIG. 3(*b*) and FIG. 3(*c*)). At this time, the roller 33, as being the elastomer, can deform according to the shape of the guided section 37. Therefore, because the guided section 37 is formed as the member different from the rack 30 so the tolerable loading is increased, the roller 33 and the guided section 37 can still smoothly engage even though a dimension of the guided section 37 includes the manufacturing deviation. In addition, because the roller 33 is rotatable, the roller 33 and the guided section 37 can smoothly engage.

After further rotation of the pinion 32 from the situation of FIG. 3(*c*) so the piston 21 reaches the top stop point, the roller 33 is detached from the guided section 37, that is, the two disengage from each other. Meanwhile, the piston 21 and blade 31 is forced to move in the bottom direction due to the pressure of the compressed gas, so as to fire the nail N via the nose 4 with high speed. When the roller 33 and the guided section 37 disengage from each other, the roller 33 may be smoothly detached from the guided section 37 since the roller 33 is rotatable.

According to aforesaid structure, due to inclusion of the cam 34, the engaged section can include teeth with higher durability than the normal ones. Besides, the friction generated during the engagement with the guided section 37 may be reduced and the driving force may be smoothly transmitted by using the roller 33 in the engagement. As a result, wearing or damage on the guided section 37 and the roller 33 may be prevented, or the loading applied to the blade 31 may be increased to thereby increase the nailing force.

Besides, light weight, miniaturization, or reduction in manufacturing costs may be achieved for the driving machine 1 because aforesaid effect may be achieved using the relatively simple mechanism.

In addition, the guided section 37 has the large cross section because the rack 30 and the guided section 37 are formed in different pitches. As such, the guided section 37 is provided with the tolerable loading higher than the that of the teeth of the rack 30. As a result, wearing or damage on the guided section 37 may be prevented, and the loading applied to the blade 31 may be increased to thereby increase the nailing force. Moreover, because the cam 34 includes the roller 33, they can still smoothly engage even though the guided section 37 has a different pitch. The so-called "smoothly engage" refers to allowing a part of the guided section 37 to be processed into different members including certain manufacturing deviation, or allowing the pitch formed by the guided section 37 and the rack 30 to include certain manufacturing deviation. Besides, light weight, miniaturization, or reduction in manufacturing costs may be achieved for the driving machine because aforesaid effect may be achieved using the relatively simple mechanism.

In addition, the guided section 37 and the roller 33 can smoothly engage because the roller 33 is the elastomer and the roller 33 deforms during the engagement.

As described above, in the first embodiment, because the roller 33 can rotate and deform according to the shape of the guided section 37, the roller 33 and the guided section 37 can smoothly engage and disengage. However, the invention is not limited by the foregoing embodiment. Other embodiments allowing the roller 33 and the guided section 37 to smoothly engage and disengage are also provided in the invention.

<Second Embodiment>

Figure 4A:
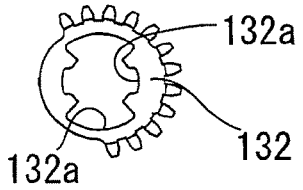
FIG. 4(*a*) illustrates a front view of a pinion, FIG. 4(*b*) illustrates a front vie and a side view of a cam and FIG. 4(*c*) illustrates a front view of the pinion connected with the cam of a driving machine according to the second embodiment of the invention.
Figure 4B:
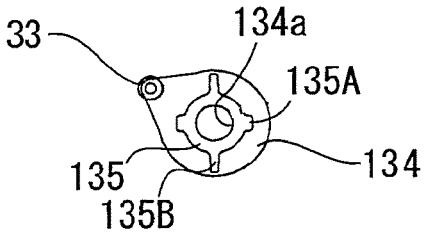
Figure 4C:
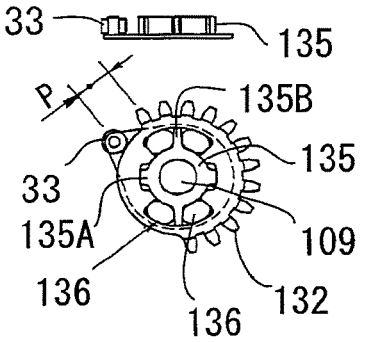
Figures 5A, 5B, 5C, 5D, 5E, 5F, 5G:
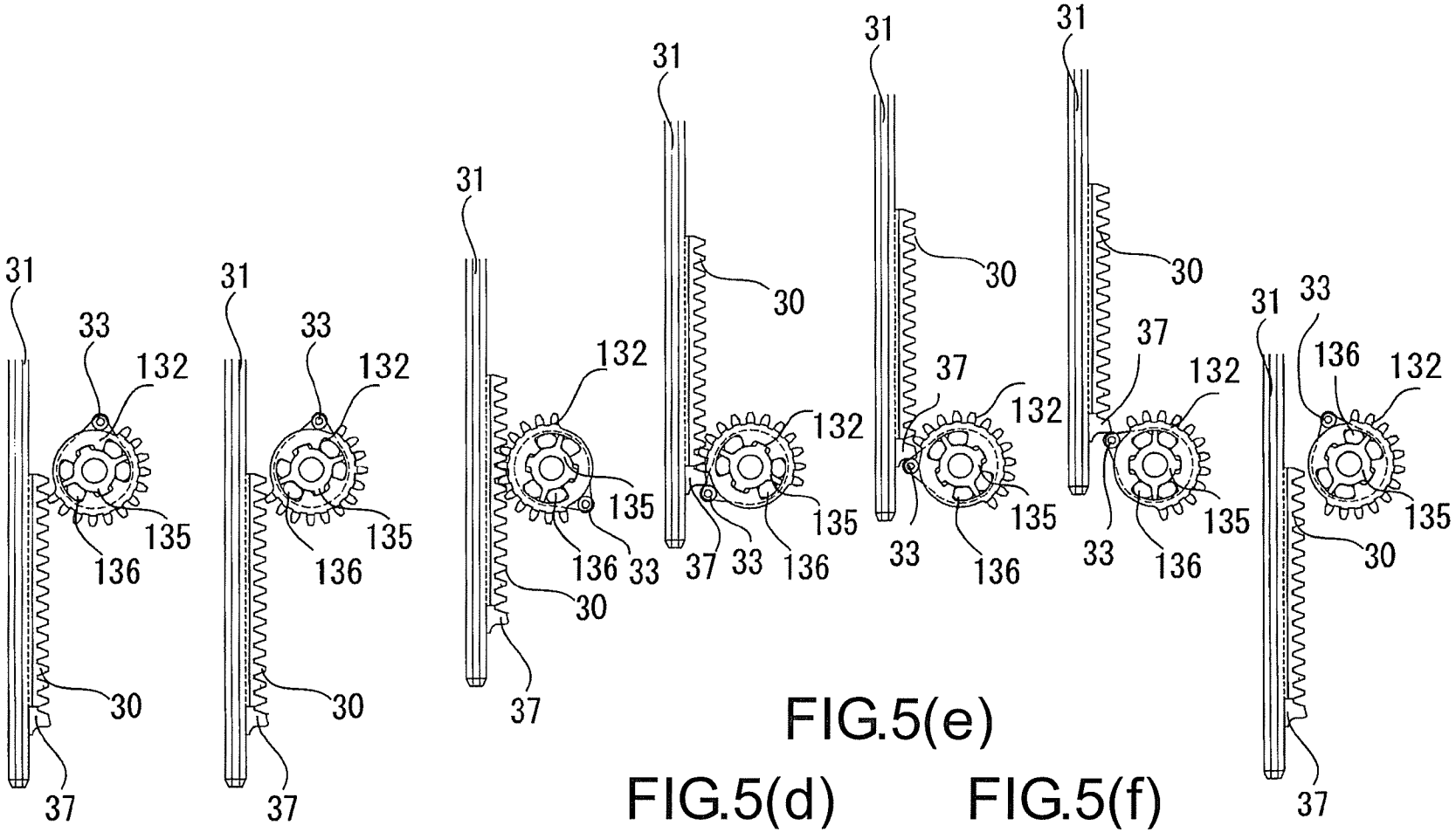
FIG. 5(*a*) to FIG. 5(*g*) are diagrams illustrating operations of a punching mechanism of the driving machine according to the second embodiment of the invention.

The second embodiment is described using FIG. 4(*a*) to FIG. 4(*c*) and FIG. 5(*a*) to FIG. 5(*g*). Further, members identical to those in the first embodiment are marked with the same reference numbers and the descriptions thereof are omitted hereinafter. Also, components or members corresponding to the components or the members constituting the driving machine 1 of the first embodiment are marked with the corresponding reference numbers in the drawing of the first embodiment plus 100.

In the second embodiment, when inspecting from the axial direction, an opening is formed in a center section of a pinion 132, and the opening prescribes four restriction sections 132*a* (FIG. 4(*a*)). Each of the restriction sections 132*a* has a shape extending along a circumferential direction. As shown in FIG. 4(*b*), a cam 134 is formed into a generally teardrop shape, and includes a protruding section 135 extending along the axial direction. An opening 134*a* for a driving shaft 109 to engage with is included on a shaft section of the cam 134.

As shown in FIG. 4(*b*), the protruding section 135 is formed into a generally cross shape extending outwardly along the radial direction when inspecting from the axial direction, and each of aims of the generally cross shape is disposed along the circumferential direction with a uniform pitch to form a pair of cam restriction sections 135A and a pair of contact sections 135B. In addition, the roller 33 is rotatably supported by the cam 134 at an end portion of the cam 134.

As shown in FIG. 4(*c*), the cam 134 loosely engages with the pinion 132. An elastomer 136, as one example of the elastic member in the invention, is inserted between the restriction section 132*a* and the contact section 135B. Further, when the cam 134 and the pinion 132 are in a state of not engaging with the rack 30 and the guided section 37 (hereinafter, referred to as "a non-engaging state"), the cam restriction section 135A and the restriction section 132*a* are separated in the circumferential direction. In the non-engaging state, a relative position of the pinion 132 relative to the cam 134 maintains fixed due to a resilience force of the elastomer 136. In addition, a pitch P is prescribed between the roller 33 and an end tooth of the pinion 132. Because the pinion 132 loosely engages with the cam 134 via the elastomer 136, the pinion 132 can shift relative to the cam 134 and the driving shaft 109 in the circumferential direction, and thus the pitch P is also variable. If the pinion 132 shifting relative to the cam 134 in the circumferential direction reaches a prescribed quantity, the restriction section 132*a* is in contact with the cam restriction section 135A to stop further shifting.

The driving shaft 109 engages with the cam 134 to transmit the driving force. That is to say, when the driving section 7 starts driving, the driving force is transmitted to the cam 134 from the driving shaft 9, and then the driving force is transmitted from the cam 134 to the pinion 132 via the elastomer 136.

Diagrams in FIG. 5(*a*) to FIG. 5(*g*) show the situation in which the cam 134 and the pinion 132 engage with the rack 30 and the guided section 37 so the blade 31 moves in the top direction.

When the pinion 132 engages with the rack 30 so the blade 31 moves in the top direction (FIG. 5(*a*) to FIG. 5(*c*)), the pinion 132 can shift relative to the driving shaft 109 and the cam 134 in the circumferential direction. In this way, the deviation of the pitch related to the rack 30 may be absorbed or the engagement may be conducted with the friction prevented.

After further rotation of the pinion 132 and the cam 134, the roller 33 engages with the guided section 37 (FIG. 5(*d*)). Because the pinion 132 is connected to the cam 134 via the elastomer 136, the pinion 132 can shift relative to the roller 33 in the circumferential direction. In this way, because the pitch P changes according to the shape of the guided section 37, the roller 33 and the guided section 37 can smoothly engage.

After further rotation of the pinion 132 and the cam 134, the blade 31 moves in the top direction (FIG. 5(*e*)). While the piston 21 reaches the top stop point, the roller 33 and the guided section 37 disengage from each other (FIG. 5(*f*) to FIG. 5(*g*)). At this time, because the pitch P is variable and the roller 33 is rotatable, the friction may be reduced so the roller 33 may be smoothly detached from the guided section 37.

When excessive loading is applied to the pinion 132, the restriction section 132*a* is in contact with the cam restriction section 135A so excessive shifting of the pinion 132 relative to the cam 134 and damage on the elastomer 136 may be prevented.

It is noted that, the roller 33 includes the elastomer in the first embodiment. However, a hard member may also be used in the second embodiment rather than being limited to the use of the elastomer. Even if aforesaid structure is adopted, the same effect may still be obtained since the elastomer 136 is provided between the pinion 132 and the cam 134.

As described above, in the second embodiment, because the pinion 132 can shift relative to the cam 134 in the circumferential direction, not only can the pinion 132 be smoothly engaging with the rack 30, the roller 33 can also smoothly engage with the guided section 37. Further, excessive deformation of the pinion 132 and damage on the elastomer 136 may be prevented by the restriction section 132*a* and the cam restriction section 135A.

<Third Embodiment>

Figure 6A:
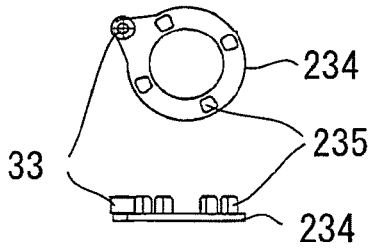
FIG. 6(*a*) illustrates a front view and a side view of a cam, FIG. 6(*b*) illustrates a front view of a pinion and FIG. 6(*c*) illustrates a front view of the pinion connected with the cam of a driving machine according to the third embodiment of the invention.
Figure 6B:
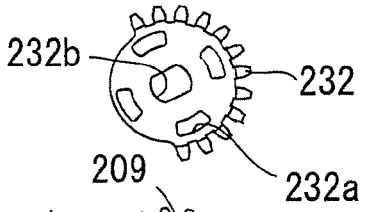
Figure 6C:
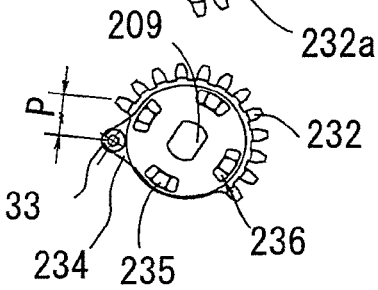
Figure 7C:
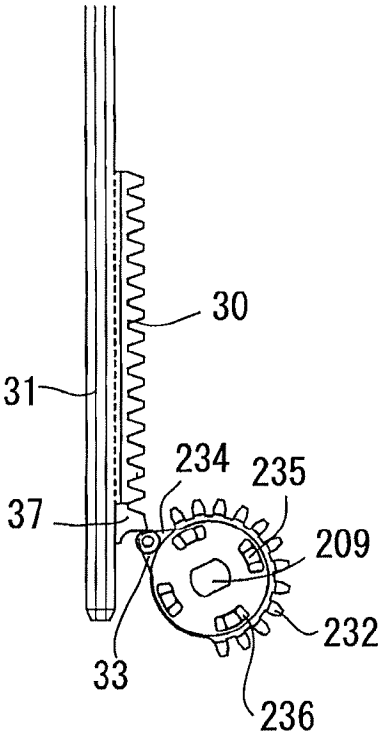
FIG. 7(*a*) to FIG. 7(*c*) are diagrams illustrating operations of a punching mechanism of the driving machine according to the third embodiment of the invention.
Figure 7B:
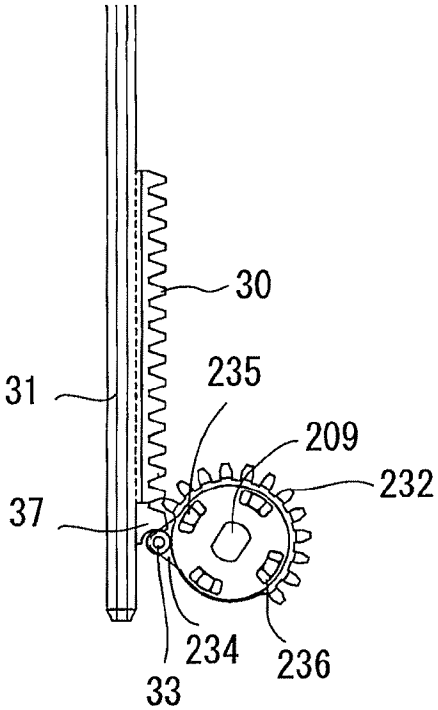
Figure 7A:
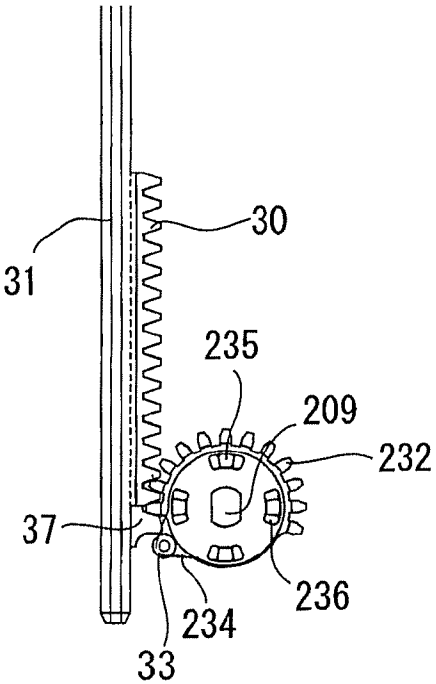
Figure 8A:
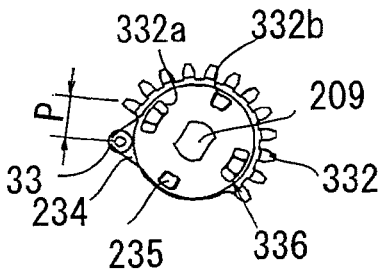
FIG. 8(*a*) to FIG. 8(*d*) are front views illustrating the pinions and the cams of driving machines according to modification examples in the invention.
Figure 8B:
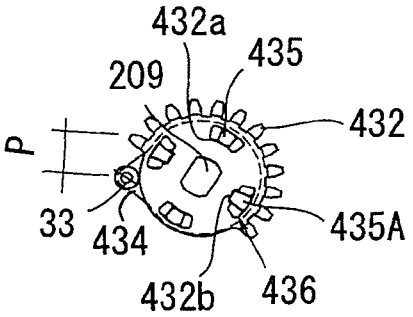
Figure 8C:
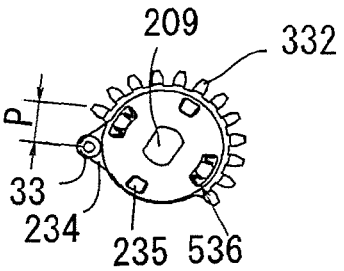
Figure 8D:
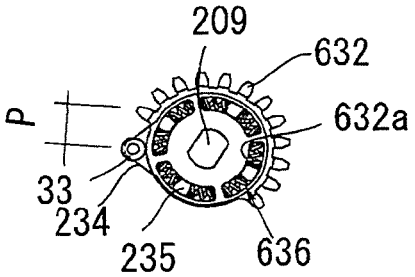

The third embodiment is described using FIG. 6(*a*) to FIG. 6(*c*) and FIG. 7(*a*) to FIG. 7(*c*). Further, members identical to those in the first embodiment and the second embodiment are marked with the same reference numbers and the descriptions thereof are omitted hereinafter. Components or members corresponding to the components or the members constituting the driving machine 1 of the second embodiment are marked with the corresponding reference numbers in the drawing of the second embodiment plus 100.

As shown in FIG. 6(*a*), in the third embodiment, a cam 234 is a member in a generally ring shape when inspecting from the axial direction with an outline formed into a generally teardrop shape when inspecting from the axial direction. Four protruding sections 235 are disposed on the cam 234. Each of the protruding sections 235 extends along the axial direction, and is disposed along the circumferential direction with a generally uniform pitch and formed into a generally rectangular shape when inspecting from the axial direction.

As shown in FIG. 6(*b*), a pinion 232 prescribes the restriction section 232*a*, and the restriction section 232*a* includes four long holes disposed along the circumferential direction with a uniform pitch. An opening 232*b* for a driving shaft 209 to engage with is included on a shaft section of the pinion 232.

As shown in FIG. 6(*c*), the cam 234 loosely engages with the pinion 232. An elastomer 236 (i.e., a resin, such as rubber), as one example of the elastic member in the invention, is inserted between the restriction section 232*a* and the protruding section 235. Specifically, the elastomer 236 is in contact with the restriction section 232*a* and the protruding section 235. Because the pinion 232 and the cam 234 are connected to each other via the elastomer 236, the cam 234 can shift relative to the pinion 232 and the driving shaft 209 in the circumferential direction so the pitch P is also variable. Further, in the non-contact state, a relative position of the pinion 232 relative to the cam 234 maintains fixed due to a resilience force of the elastomer 236.

The driving shaft 209 engages with the pinion 232 to transmit the driving force to the pinion 232. That is to say, when the driving section 7 starts driving, the driving force is transmitted from the driving shaft 209 to the pinion 232, and then the driving force is transmitted from the pinion 232 to the cam 234 via the elastomer 236.

Diagrams in FIG. 7(*a*) to FIG. 7(*c*) show a situation starting when the roller 33 and the guided section 37 engage with each other until they are about to disengage from each other.

When the roller 33 engages with the guided section 37 (FIG. 7(*a*)), the roller 33 connected to the cam 234 can shift relative to the pinion 232 in the circumferential direction. Therefore, because the pitch P changes according to the shape of the guided section 37, the roller 33 and the guided section 37 can smoothly engage.

After further rotation of the pinion 232 and the cam 234, the blade 31 shifts in the top direction (FIG. 7(*b*)). While the piston 21 reaches the top stop point, the roller 33 and the guided section 37 disengage from each other. At this time, because the roller 33 is rotatable, the roller 33 may be smoothly detached from the guided section 37 (FIG. 7(*c*)).

It is noted that, the roller 33 includes the elastomer in the first embodiment. However, a hard member may also be used in the third embodiment. Even if aforesaid structure is adopted, the same effect may still be obtained since the elastomer 236 is provided between the pinion 232 and the cam 234.

As described above, in the third embodiment, because the cam 234 can shift relative to the pinion 232 in the circumferential direction, the roller 33 and the guided section 37 can smoothly engage.

<Modification Examples>

Diagrams in FIG. 8(*a*) to FIG. 8(*d*) are the modification examples. Further, members identical to those in the first embodiment, the second embodiment and the third embodiment are marked with the same reference numbers and the descriptions thereof are omitted hereinafter. Also, components or members corresponding to the components or the members constituting the driving machine 1 of the third embodiment are marked with the corresponding reference numbers in the drawing of the first embodiment plus multiples of 100.

A pinion 332 shown in FIG. 8(*a*) includes a pair of restriction sections 332*a* and a pair of restriction sections 332*b* having a shape shorter than the restriction section 332*a* in the circumferential direction. The restriction section 332*a* and the restriction sections 332*b* are alternately disposed along the circumferential direction with a generally uniform pitch. Unlike the third embodiment, the restriction section 332*b* loosely engages with the protruding section 235 without the elastomer. A gap is formed in the circumferential direction between the restriction section 332*b* and the protruding section 235. Accordingly, the cam 234 can shift relative to the pinion 232 in the circumferential direction. When the cam 234 shifting relative to the pinion 232 reaches a prescribed quantity, the restriction section 332*b* is in contact with the protruding section 235 so excessive shifting of the cam 234 relative to the pinion 332 may be prevented and excessive deformation and damage on the elastomer 336 may also be prevented.

FIG. 8(*b*) shows another modification example. A cam 434 includes: a pair of protruding sections 435, having a shape identical to the protruding section 235 in the third embodiment; and a pair of protruding sections 435A, having a shape longer than protruding section 435 and extending inwardly along a radial direction of the cam 434. A pinion 432 includes a pair of restriction sections 432*a* having a shape identical to the restriction section 232*a* in the third embodiment and a pair of restriction sections 432*b*. Each of the restriction sections 432*b* can loosely engage with the protruding section 435A to show a shape protruding inwardly along a radial direction of the pinion 432, which is formed into a generally inverted "T" shape when inspecting from the axial direction. A gap is formed in the circumferential direction between the restriction section 432*b* and the protruding section 435A. Accordingly, the cam 434 can shift relative to the pinion 432 in the circumferential direction. When the cam 434 shifting relative to the pinion 432 reaches a prescribed quantity, the restriction section 432*b* is in contact with the protruding section 435A so excessive shifting of the cam 434 relative to the pinion 432 may be prevented and excessive deformation and damage on the elastomer 436 may also be prevented.

In the foregoing embodiments, the elastomer resin, such as rubber, is used as the elastomer between the pinion and the cam. However, the invention is not limited to such implementation, any material or structure with desired resilience coefficient or spring constant may also be adopted. For example, in addition to elastic materials (the elastic resin) such has rubber, a structure that functions as the so-called "gas spring" (a structure that utilizing a resilient force of a gas by sealing the gas into an enclosed space, for example) also falls within the scope of the invention. Further, a flat spring or a coil spring containing a metal sheet or a resin sheet may also be used as the example for structurally constituting the elastomer, and specific examples thereof same are provided as follows.

Shapes of the pinion 332 and the cam 234 shown in FIG. 8(*c*) are identical to those in FIG. 8(*a*), but a flat spring 536 is used as the elastomer instead. According to aforesaid structure, because the flat spring 536 can deform in the circumferential direction of the pinion 332, the same effect of the FIG. 8(*a*) may still be obtained.

A pinion 632 shown in FIG. 8(*d*) includes four restriction sections 632*a* having a shape longer than the pinion 232 of the third embodiment in the circumferential direction. A coil spring 636, as the elastomer, is inserted between the protruding section 235 and the restriction section 632*a*. According to aforesaid structure, because the coil spring 636 is in contact with the protruding section 235 and the restriction section 632*a* and can shift relative to the circumferential direction of the pinion 632 according to the cam 234 to cause an elastic deformation, the same effect of the third embodiment may still be obtained.

Furthermore, in the foregoing embodiments, the elastomer is provided between the pinion and the cam. Nonetheless, the invention is not limited to the above, and the elastomer may also be provided between the driving shaft and the pinion or the cam instead.

For example, in the first embodiment, the elastomer may also be set to be provided between the driving shaft 9 and the pinion 32. According to aforesaid structure, because the pinion 32 and the cam 34 can shift in the circumferential direction, the pinion 32 and the rack 30 can smoothly engage and the guided section 37 and the roller 33 can also smoothly engage and disengage.

Further, in the second embodiment, the elastomer may also be set to be further provided between the driving shaft 109 and the cam 134. If aforesaid structure is set, the cam 134 can shift relative to the driving shaft 109 in the circumferential direction so the guided section 37 and the roller 33 can smoothly engage and disengage. Therefore, the friction during the engagement of the pinion 132 and the rack 30 or during the engagement of the roller 33 and the guided section 37 may be prevented or reduced so they can smoothly engage even though the pitch of the rack 30 includes the deviation or the rack has a different pitch. As a result, wearing or damage on the engaged section may be prevented, or the loading applied to the blade may be increased to thereby increase the nailing force. Besides, light weight, miniaturization, or reduction in manufacturing costs may be achieved for the driving machine 1 because aforesaid effect may be achieved using the relatively simple mechanism.

Further, the cam 134 may also serve as a front end portion of the driving shaft 109 to be integrally formed with the driving shaft 109. In this case, because the cam restriction section 135A is in contact with the restriction section 132*a* so a relative shifting of the pinion 132 relative to the circumferential direction of the driving shaft is restricted. Such implementation is also able to prevent excessive shifting of the pinion 132 or plastic deformation and damage on the elastomer 136.

<Fourth Embodiment>

Figure 9:
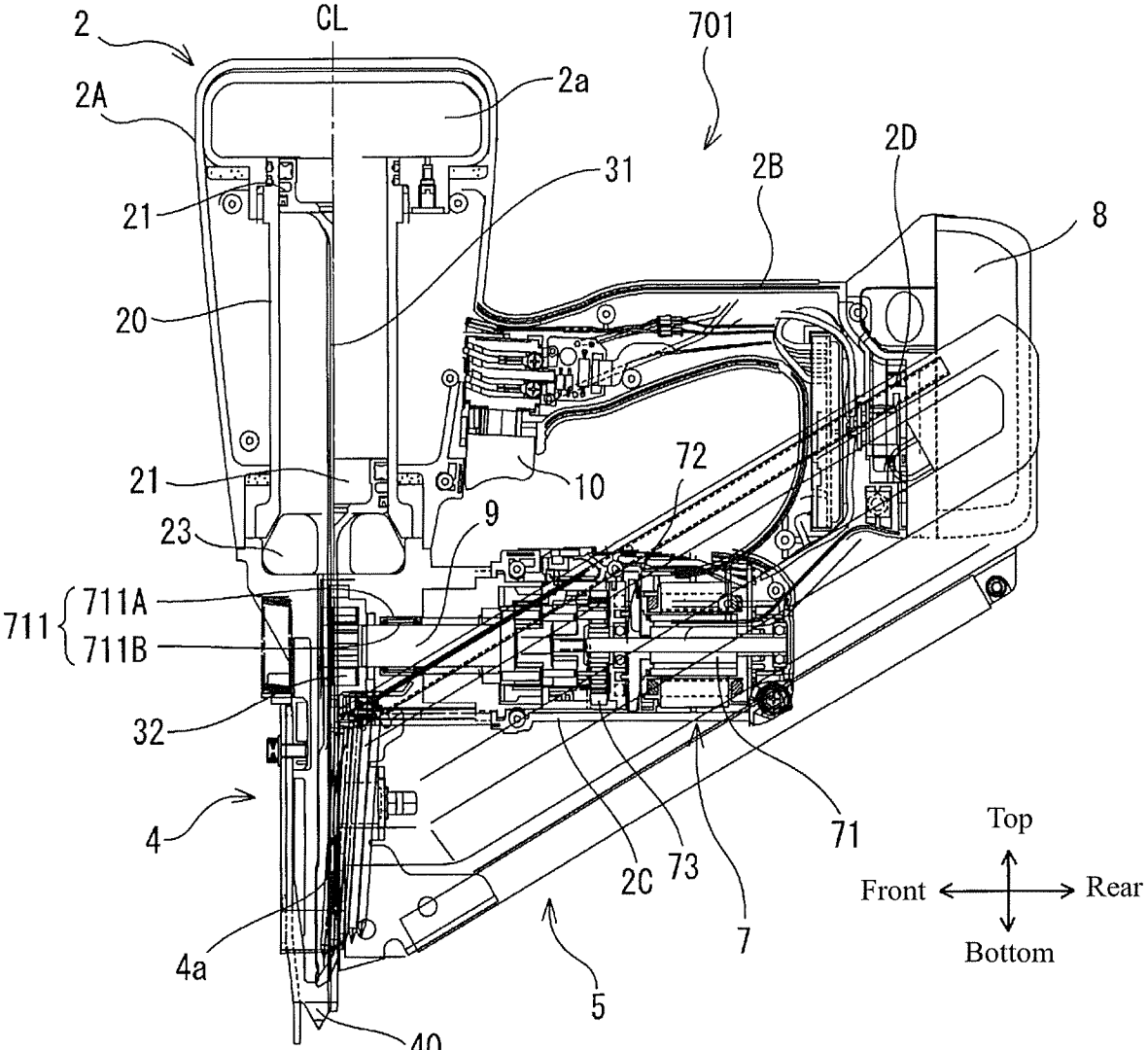
FIG. 9 is a cross sectional view of a driving machine according to the fourth embodiment of the invention.
Figure 10:
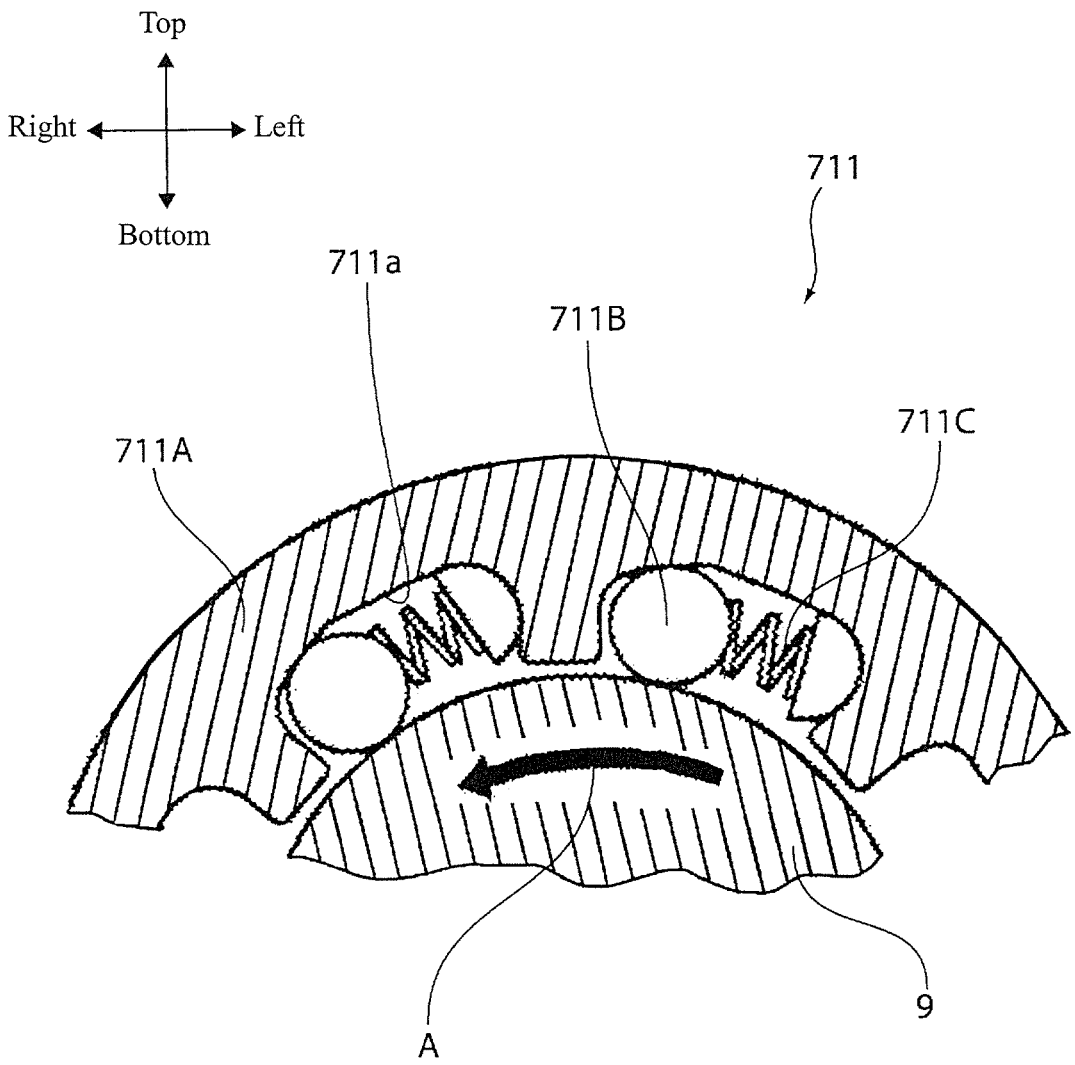
FIG. 10 illustrates a partially enlarged cross sectional view of a one-way clutch of the driving machine according to the fourth embodiment of the invention, which is a diagram showing the situation where a backward rotation of a driving shaft is restricted by the one-way clutch.

Next, a driving machine 701 of the fourth embodiment is described using FIG. 9 and FIG. 10. Further, members identical to those in the first embodiment are marked with the same reference numbers and the descriptions thereof are omitted hereinafter. FIG. 9 is a cross sectional view of the driving machine 701. FIG. 10 illustrates a partially enlarged cross sectional view of a one-way clutch 711 of the driving machine 7, which is a diagram showing the situation where a backward rotation of the driving shaft 9 is restricted by the one-way clutch 711.

As shown in FIG. 9 and FIG. 10, the one-way clutch 711 is disposed in the driving section accommodating section 2C of the driving machine 701. The one-way clutch 711 is a member allowing a forward rotation (a rotation in the clockwise direction in FIG. 3(*a*) to FIG. 3(*c*)) and restricting a backward rotation (a rotation in the counterclockwise direction in FIG. 9 or a rotation facing a rotation direction A in FIG. 10) for the driving shaft 9 and the pinion 32 that rotates together with the driving shaft 9. The one-way clutch 711 is disposed between an inner wall of the driving section accommodating section 2C and the driving shaft 9, and includes a tube section 711A and a plurality of rollers 711B. Furthermore, the one-way clutch 711 is one example of the backward rotation restriction mechanism, and a direction of the forward rotation is the rotation direction for moving the piston 21 and the blade 31 in the top direction.

The tube section 711A is a cylinder shape extending along the front/rear direction and secured on the inner wall of the driving section accommodating section 2C. A plurality of accommodating slots 711*a* are formed on an inner circumference surface of the tube section 711A. The accommodating slots 711*a* are slots formed caving outwardly from the inner circumference surface of the tube section 711A along the radial direction and extending in the front/rear direction. Each of the accommodating slots 711*a* is accommodated with one of the rollers 711B.

The roller 711B is a needle-shaped roll extending in the front/rear direction, which may be accommodated in the accommodating slot 711*a* when rotating with its axis as the center and being in contact with the driving shaft 9. Further, in the accommodating slot 711*a*, the roller 711B is unable to move in the front/rear direction but move along the circumferential direction for a prescribed quantity. In the present embodiment, the prescribed quantity is a length substantially identical to a diameter of the roller 711B.

A depth of the accommodating slot 711*a* gradually becomes deeper from an upstream side to a downstream side of the accommodating slot 711*a* in the direction of the forward rotation of the driving shaft 9, a depth of an upstream side edge section is shorter than the diameter of the roller 711B, and a depth of a downstream side edge section is substantially identical to the diameter of the roller 711B. In addition, a force member (i.e., a spring 711C) is provided between the roller 711B accommodated in the accommodating slot 711*a* and the downstream side edge section of the accommodating slot 711*a*, and thus the roller 711B is forced from the downstream side edge section to the upstream side edge section.

Here, functions of the one-way clutch 711 are described as follows. After the forward rotation is started by the driving shaft 9, each of the rollers 711B in contact with an outer circumference surface of the driving shaft 9 rotates with its axis as the center inside the respective one of the accommodating slots 711*a*, and starts to move from the upstream side edge section to the downstream side edge section in the direction of the forward rotation of the driving shaft 9 while withstanding the force from the spring 711C. If the roller 711B is located on the downstream side edge section at the deepest of the accommodating slot 711*a*, a pressure on a contact surface of the outer circumference surface of the driving shaft 9 and the roller 711B may be reduced. In this case, the friction between each of the rollers 711B and the outer circumference surface of the driving shaft 9 caused by the pressure on the contact surface does not interfere the forward rotation of the driving shaft 9 relative to the tube section 711A. In such case, the driving shaft 9 is able to continue the forward rotation. That is to say, the one-way clutch 711 allows the driving shaft 9 and the pinion 32 to rotate forwardly.

On the other hand, after the backward rotation is started by the driving shaft 9, each of the rollers 711B rotates with its axis as the center inside the respective one of the accommodating slots 711*a*, and starts to move from the downstream side edge section to the upstream side edge section in the direction of the forward rotation of the driving shaft 9 while withstanding the force from the force member (i.e., the spring 711C). If the roller 711B is located on the downstream side edge section at the shallowest of the accommodating slot 711*a*, the pressure on the contact surface of the outer circumference surface of the driving shaft 9 and the roller 711B becomes the greatest. In this case, the friction between each roller 711B and the outer circumference surface of the driving shaft 9 caused by the pressure on the contact surface becomes the greatest so the driving shaft 9 is unable to rotate backwardly relative to the tube section 711A (the situation shown by FIG. 10). That is to say, the one-way clutch 711 restricts the driving shaft 9 and the pinion 32 from rotating backwardly.

In this way, in the driving machine 701 according to the fourth embodiment, the backward rotation of the driving shaft 9 and the pinion 32 may the restricted because of the one-way clutch 711 disposed on the driving section accommodating section 2C (i.e., between the housing 2 and the driving shaft 9). As a result, a usability of the driving machine 701 may be improved.

Specifically, in the middle of moving the piston 21 and the blade 31 from the bottom stop point to the top stop point (e.g., the situation shown by FIG. 3(*a*) to FIG. 3(*c*)), when the motor 71 stops driving due to reduction in a remaining capacity of the cell 8, the pinion 32 loses the driving force for withstanding the pressure from the pressure chamber 2*a* and moving the piston 21 and the blade 31 in the top direction (the direction to the top stop point). In the middle of the aforesaid movement, due to the engagement (joggle) of the pinion 32 and the rack 30 or the engagement of the roller 33 and the guided section 37, if the pinion 32 loses the driving force, the piston 21 and the blade 31 is then forced (pressed) in the bottom direction due to the pressure from the pressure chamber 2*a* so the force causing the backward rotation of the pinion 32 and the driving shaft 9 may be applied to the pinion 32 and the driving shaft 9. In this case, the backward rotation of the pinion 32 and the driving shaft 9 may leads to a poorer usability. For example, if the piston 21 and the blade 31 move towards the bottom stop point before reaching the top stop point, the nail N may be driven with a weaker nailing force as compared to when the top stop point is reached, the nail N cannot be completely driven, a finishing grade becomes poorer, the nail N must be driven once again, etc.

However, due to inclusion of the one-way clutch 711, the driving machine 701 can restrict the backward rotation of the driving shaft 9 and the pinion 32 and can restrict the movement of the piston 21 and the blade 31 in the bottom direction. In this way, the aforementioned problems are solved so the finishing grade may be favorably maintained and the usability may be improved.

The driving machine of the invention is not limited by the foregoing embodiments, and various modifications may be made without changing the spirit in the scope of the subject matters in the invention.

In the foregoing embodiments, the roller 33 is connected to the pinion or the cam. Nonetheless, the invention is not limited to the above. The roller 33 may also be set to be disposed on the rack 30 or the guided section 37. If aforesaid structure is set, the rack 30 (or the guided section 37) and the cam (or the pinion) can smoothly engage or disengage. Moreover, in such case, the roller 33 and the rack 30 (or the roller 33 and the guided section 37) are equivalent to the roller mechanism in the invention. Furthermore, in such case, the pinion and the cam are equivalent to the engaged section in the invention, whereas the rack 30, the guided section 37 and the roller 33 are equivalent to the engaging section in the invention.

In the foregoing embodiments, the roller is connected to the pinion or the cam. Nonetheless, the invention is not limited to the above, and it is also possible to use a structure not disposed with the roller. If aforesaid structure is set, because the elastomer is provided and the elastomer can deform, the guided section 37 and the cam can still smoothly engage and disengage. Therefore, the guided section 37 and the cam can still smoothly engage because the friction during the engagement of the cam and the guided section 37 may be prevented or reduced even though the pitch of the guided section 37 and the rack 30 includes the deviation or the rack has a different pitch. Besides, light weight, miniaturization, or reduction in manufacturing costs may be achieved for the driving machine 1 because aforesaid effect may be achieved using the relatively simple mechanism.

In the foregoing embodiments, the driving machine 1 that drives the nail as the fastener is illustrated as one example of the driving machine, but the invention is not limited thereto. The invention may be applied to all tools that can serve as the driving machine and fire mechanical joint fittings including nails, screws, staples, etc. Furthermore, general fasteners in the related art, such as screws, nails, drawing pins, rivets, staples, etc., may also be considered as the specific example of the fastener.

Although the driving section 7 of electric type having the motor 71 is used as one example, the invention is not limited thereto. The invention is also suitable in other driving machines with other driving method including solenoid or the like.

In the foregoing embodiments, the gas spring using the compressed gas is illustrated as one example of the force member serving as the blade for driving the fastener, but the invention is not limited thereto. For example, it is obvious for persons skilled in the art that the invention may apply other force members such as the coil spring and the like.

Although the one-way clutch 711 having the rollers 711B is used in the fourth embodiment, a ball-type one-way clutch having balls and ball slots formed on an inner circumference surface may also be used as long as the structure restricting the backward rotation and allowing the forward rotation for the driving shaft 9 and the pinion 32 may be provided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving machine, comprising:

a nose, extending in a prescribed direction;

a housing, having the nose;

a blade, having an engaging section, movably guided in the housing in the prescribed direction, and capable of driving a fastener via the nose; and a transmission mechanism, having an engaged section for engaging with the engaging section in order to transmit a driving force, wherein the engaged section comprises a pinion and a movable tooth, the pinion has teeth forming a teeth row with the movable tooth, and the movable tooth is capable of moving relative to the pinion in a circumferential direction of the pinion, and a pitch between the movable tooth and an end tooth of the teeth of the pinion is variable, the movable tooth guides the engaging section and the engaged section to disengage from each other, and the engaged section comprises one end portion for starting an engagement with the engaging section and another end portion for disengaging the engagement via the movable tooth.

2. The driving machine according to claim 1, wherein the transmission mechanism further comprises a driving shaft for transmitting the driving force to the engaged section, wherein the driving shaft is connected to the pinion.

3. The driving machine according to claim 1, wherein the transmission mechanism further comprises a restriction section, wherein the pinion is in contact with the movable tooth at the restriction section so a relative shifting of the movable tooth relative to the pinion is restricted.

4. The driving machine according to claim 1, wherein the engaging section comprises a rack and a guided section guided by the movable tooth, and the engaging section and the guided section are formed in different pitches.

5. The driving machine according to claim 1, wherein the movable tooth is comprised in a roller formed by an elastomer material.

6. The driving machine according to claim 1, wherein the movable tooth is connected to the pinion through an elastic member.

* * * * *